US009086254B1

(12) United States Patent
Plappert

(10) Patent No.: US 9,086,254 B1
(45) Date of Patent: Jul. 21, 2015

(54) MODULAR HANDGUN HOLSTER

(71) Applicant: William Joseph Plappert, Loxahatchee, FL (US)

(72) Inventor: William Joseph Plappert, Loxahatchee, FL (US)

( * ) Notice: Subject to any disclaimer, the term of this patent is extended or adjusted under 35 U.S.C. 154(b) by 172 days.

(21) Appl. No.: 14/057,374

(22) Filed: Oct. 18, 2013

(51) Int. Cl.
*F41C 33/02* (2006.01)

(52) U.S. Cl.
CPC ..... *F41C 33/0236* (2013.01); *F41C 33/0227* (2013.01); *F41C 33/0245* (2013.01)

(58) Field of Classification Search
CPC .. F41C 33/02; F41C 33/0236; F41C 33/0227; F41C 33/0245
See application file for complete search history.

(56) References Cited

U.S. PATENT DOCUMENTS

| | | | | | |
|---|---|---|---|---|---|
| 4,325,506 | A | | 4/1982 | Lindell et al. | |
| 4,424,924 | A | | 1/1984 | Perkins | |
| 4,577,787 | A | | 3/1986 | Hersey | |
| 4,787,540 | A | | 11/1988 | Barry | |
| 5,358,160 | A | * | 10/1994 | Bianchi | 224/244 |
| 5,449,103 | A | * | 9/1995 | Tilley | 224/244 |
| 5,513,785 | A | | 5/1996 | Campagna, Jr. | |
| 5,528,770 | A | * | 6/1996 | Castilla et al. | 340/7.63 |
| 5,570,827 | A | * | 11/1996 | Wiesner | 224/587 |
| 5,622,295 | A | | 4/1997 | Hellweg et al. | |
| 6,092,703 | A | | 7/2000 | Johnson | |
| 6,125,513 | A | * | 10/2000 | Cheraso et al. | 24/3.11 |
| 6,264,079 | B1 | * | 7/2001 | Skaggs | 224/193 |
| 6,732,891 | B2 | | 5/2004 | Locklear, III | |
| 6,763,984 | B2 | | 7/2004 | Gallagher | |
| 7,204,395 | B2 | | 4/2007 | Gallagher | |
| 7,866,515 | B1 | * | 1/2011 | Buis et al. | 224/197 |
| 8,371,487 | B1 | | 2/2013 | Plappert | |
| 2002/0047029 | A1 | | 4/2002 | Liao | |
| 2005/0127121 | A1 | * | 6/2005 | Wells | 224/193 |
| 2005/0178808 | A1 | * | 8/2005 | Buis et al. | 224/198 |
| 2005/0184115 | A1 | * | 8/2005 | Wells | 224/193 |
| 2005/0268518 | A1 | * | 12/2005 | Pikielny | 42/90 |
| 2006/0065689 | A1 | | 3/2006 | Johnson | |
| 2006/0175366 | A1 | | 8/2006 | Dekaise | |
| 2006/0219743 | A1 | | 10/2006 | Gallagher | |
| 2006/0226185 | A1 | * | 10/2006 | Har-Shen | 224/244 |
| 2007/0175935 | A1 | | 8/2007 | Clifton | |
| 2011/0266317 | A1 | * | 11/2011 | Clifton | 224/242 |
| 2013/0299543 | A1 | * | 11/2013 | Rorick et al. | 224/674 |

* cited by examiner

*Primary Examiner* — Brian D Nash
(74) *Attorney, Agent, or Firm* — Albert Bordas, P.A.

(57) ABSTRACT

A modular handgun holster, having a holster assembly with first and second internal longitudinal channels defined by first, second, third, and fourth rail guides respectively. A spacer assembly is positioned within the holster assembly. A belt clip assembly has first and second elongated notches interchangeably mounted onto the first or second internal longitudinal channel of the holster assembly. The belt clip assembly further has a first locking protrusion. A waistband clip assembly has third and fourth elongated notches interchangeably mounted onto the first or second internal longitudinal channel of the holster assembly. The waistband clip assembly further has a second locking protrusion. The holster assembly is symmetrical or approximately symmetrical to snugly receive a handgun.

20 Claims, 4 Drawing Sheets

MODULAR HANDGUN HOLSTER

BACKGROUND OF THE INVENTION

1. Field of the Invention

The present invention relates to holsters, and more particularly, to handgun holsters that fit in between a user's belt and pant waistband.

2. Description of the Related Art

Practical and secure holsters are often desired for increased firearm safety, while they provide readability for use.

Applicant believes that one of the closest references corresponds to U.S. Pat. No. 8,371,487 B1 issued William Joseph Plappert, the inventor of the instant invention, on Feb. 12, 2013 for a handgun holster. However, it differs from the present invention because Plappert's previous patent teaches a handgun holster comprising a holster assembly and a strap assembly. The holster assembly consists of a U-shaped exterior wall with top, bottom, and lateral edges. Extending from the top edge is a bend that defines a tension arm. Positioned within the exterior wall are bushings. The belt strap assembly has exterior and interior faces, third and fourth ends, and at least one hole. The belt strap assembly has female and male snaps adjacent to the ends. The male snap mounts onto a selected hole of the interior face by a screw that trespasses the first bushing and screws into a bolt. A second screw trespasses the second bushing and screws into a second bolt. The holster assembly is worn in between a waistband of an article of clothing and a belt. The tension arm is fitted over the waistband and the belt strap assembly wraps around the belt.

Applicant believes that another reference corresponds to U.S. Patent Application Publication No. 20020047029 A1, published on Apr. 25, 2002 to Liao for a pistol protective holster with one-way safety means. However, it differs from the present invention because Liao teaches a pistol protective holster with one-way safety means mainly comprising of a protective holster main sandwich with several clamping, a pair of clamping and receiving members with triangular and trapezoidal cut planes, two strip-shaped spring leaves, and a frame protecting cover, furthermore, an expanding member formed at the fold of the protective holster main sandwich; since a pair of clamping and receiving members with triangular and trapezoidal structures positions the pistol body at the sectional space where the expanding member presses against the protective holster main sandwich with the assistance of the tightly forcing resilience from the middle of two spring leaves, thereby the method of drawing the pistol from the inside of the protective holster features a safety efficacy of only allowing the removing of the pistol by pressing against one-way toward the inner side of the human body.

Applicant believes that another reference corresponds to U.S. Patent Application Publication No. 20060065689 A1, published on Mar. 30, 2006 to Johnson for a flashlight holster. However, it differs from the present invention because Johnson teaches a flashlight leather or plastic holster tailored to receive articles of cylindrical configuration, such as flashlights, pepper spray cans, collapsible batons, etc., provided the articles have similar diameters for a given holster. The holster provides for adjustable tension to be placed on the article the leather holster forms a generally cylindrical leather cavity drawn to a smaller diameter collar spaced upward from its lower end upon which the tail or the bezel of a flashlight may rest to provide additional protection to the bezel. The leather holster may form a generally cylindrical leather cavity extending the full length of the holster. The holster is configured to hold the flashlight at a forward or backward angle for smooth, ergonomic draw of the light by the user. A one-way snap strap is provided for attachment over waist belts of a variety of widths.

Applicant believes that one of the closest references corresponds to U.S. Pat. No. 4,577,787 B1 issued to Hersey on Mar. 25, 1986 for an invertible and reversible holster. However, it differs from the present invention because Hersey teaches a holster made of two matching pieces of material joined together to form a double-ended gun pocket, shaped to fit a particular gun and contain substantial portions of it. The holster has a belt loop on each face of the gun pocket and a belt slot through both faces outside of the trigger guard area, which position the gun and holster on a belt at an acute angle from the vertical, such that a forward-tilt and a cross-draw slant mode of carry are both made possible by inverting the holster and thus reversing the angle. Reversing the holster laterally changes it from right-handed to left-handed.

Applicant believes that one of the closest references corresponds to U.S. Pat. No. 4,787,540 B1 issued to Barry on Nov. 29, 1988 for a handgun holster selectably configured and to be placed on a belt. However, it differs from the present invention because Barry teaches a hand gun holster to operationally hold a thirty eight revolver, an automatic pistol or another hand gun, has a pair of belt loops made of polypropylene medium weight webbing in turn positioned and supported by a pair of curvable assemblies of heavy weight nylon webbing having sewn thereon respectively and cooperatively spaced heavy duty nap, i.e. loop, and hook fastening materials, with these pair of curvable assemblies being arranged in alignment to receive and to hold an automatic pistol, and being arranged perpendicularly to receive and to hold a thirty eight revolver.

Applicant believes that one of the closest references corresponds to U.S. Pat. No. 6,092,703 B1 issued to Johnson on Jul. 25, 2000 for a holster having a frontal reinforcement. However, it differs from the present invention because Johnson teaches a holster having a reinforced front portion to prevent the holster from collapsing under pressure from the wearer's belt when the gun is drawn. The holster is preferably made from rigid leather, molded to conform to the specific gun intended to be carried. A rigid leather reinforcement, which may also include a metal or plastic plate, along only the front portion of the holster is sufficient to keep the holster open when the gun is drawn, without increasing the thickness of the holster, thereby maintaining concealability. This reinforcement is particularly desirable for inside waistband holsters. Such an inside waistband holster may have a single central or rearward belt loop, or a pair of belt loops, with one mounted in front and the other at the rear. The belt loops may be reversible for weak side wear. Additionally, the reinforcement may be used with strong side or crossdraw belt holsters.

Applicant believes that one of the closest references corresponds to U.S. Patent Application Publication No. 2007/0175935 A1, published on Aug. 2, 2007 to Clifton for a holster handgun locator and lock. However, it differs from the present invention because Clifton teaches a handgun that is releasably secured in a holster by a lever pivotally mounted to the holster carrying a forward locking member for positively engaging a handgun portion locking it in place. A rearward lever portion is movable by a user to pivot it away from engaging a handgun so that it can be withdrawn from the holster. A positioning member is affixed to a holster and engages the handgun, which may include a tension device. A muzzle positioner may be used to engage within the bore of the muzzle, which includes an alignment pin and an attachment fastener to the holster.

Applicant believes that another reference corresponds to U.S. Pat. No. 6,732,891 B2 issued to Locklear, III on May 11, 2004 for a secure, quick-release handgun holster. However, it differs from the present invention because Locklear, III teaches a holster that includes: (a) a frame support (23) with an open top, comprising a bottom end (22) and at least one side panel (15); (b) a retention assembly (30) including a retention bracket (31), a retention plate (34) adjacent to a side of the retention bracket, and a trigger-impinging means (37) projecting from a side of the retention plate (34) into the retention bracket (31); (c) a spring-loaded actuator assembly (29) including an actuator (40) connected to an actuator arm (42), a portion of the actuator (40) extending through the side panel (15) to the outside, a portion of the actuator arm (42) extending inwardly through the side panel 15 into the retention bracket (31) and to the retention plate (34); and (d) a stabilizer spring assembly (79) including a stabilizer pin (81) having a base affixed to panel of the holster, and a movable power spring (80) substantially surrounding the stabilizer pin.

Applicant believes that another reference corresponds to U.S. Patent Application Publication No. 2006/0219743 A1, published on Oct. 5, 2006 to Richard N. Gallagher for a canted universal elastic polymer holster hanger with indistinguishable belt lock and flex arm to conceal holster, to produce shirt-engaging flex cam surface, and to produce flexed gun securing surface. However, it differs from the present invention because Gallagher teaches a method and apparatus for flexing a concealed holster to secure the contents of the holster in the holster. An elongate substantially rigid elastically flexible sling is secured to a side of the holster such that the elongate member and side of the holster can be partially separated so the wearer's shirts can be inserted therebetween to conceal the holster. The lower end of the sling can be flexed outwardly away from the side of the holster such that a portion of the outer side adjacent the lower end is, when the sling is flexed outwardly to insert the wearer's shirt, flexed inwardly to compress a pistol in the storage compartment.

Applicant believes that another reference corresponds to U.S. Pat. No. 7,204,395 B2 issued to Gallagher on Apr. 17, 2007 and U.S. Pat. No. 6,763,984 B2 issued to Gallagher on Jul. 20, 2004 both for a canted universal elastic polymer holster hanger with indistinguishable belt lock and flex arm to conceal holster, to produce shirt-engaging flex cam surface, and to produce flexed gun securing surface. However, they differ from the present invention because Gallagher's patented inventions teach a method and apparatus for flexing a concealed holster to secure the contents of the holster in the holster. An elongate substantially rigid elastically flexible sling is secured to a side of the holster such that the elongate member and side of the holster can be partially separated so the wearer's shirts can be inserted therebetween to conceal the holster. The lower end of the sling can be flexed outwardly away from the side of the holster such that a portion of the outer side adjacent the lower end is, when the sling is flexed outwardly to insert the wearer's shirt, flexed inwardly to compress a pistol in the storage compartment.

Applicant believes that another reference corresponds to U.S. Patent Application Publication No. 2006/0175366 A1, published on Aug. 10, 2006 to Daniel Dekaise for a security and retention device for a handgun. However, it differs from the present invention because Dekaise teaches an automatic safety and retention device for a gun holster, preferably for a handgun. The device comprises a cover (5) which connects the outer side (2) and the inner side (3) of the holster body at the top thereof and which pivots forward from a closed position to an open position under the action of at least one part of the hand of the carrier when the gun is being removed from the holster or spontaneously by the gun when it is being placed in the holster.

Applicant believes that another reference corresponds to U.S. Pat. No. 5,622,295 B1 issued to Hellweg, et al. on Apr. 22, 1997 for a holster for handguns or the like. However, it differs from the present invention because Hellweg, et al. teaches a holster for a handgun comprising a holster body for receiving the handgun, the holster body being mounted on a belt receiving member; the holster body having an open top for receiving the handgun, and an open bottom to allow a barrel of the handgun to project therethrough if required; the holster body is of a folded construction having two substantially parallel but spaced apart ends shaped to conform with the barrel and/or slide of the handgun to define an open side therebetween, there being provided at least one adjustable tension means passing between the ends and across the open side to retain the ends in a desired but adjustable spaced relationship.

Applicant believes that another reference corresponds to U.S. Pat. No. 5,513,785 B1 issued to Campagna, Jr. on May 7, 1996 for a gun retention system. However, it differs from the present invention because Campagna, Jr. teaches a gun retention system for an officer to securely lock his weapon inside his holster while at the same time allowing quick and easy drawing of the weapon and maintaining a physical connection between the weapon and the officer's security belt. The gun retention system comprises a weapon grip, a security belt, and a spool housing. The weapon grip contains a connector, which attaches to the security belt and can be either right-handed or left-handed. The other end of security belt is connected to a spool and is coiled around the spool inside the spool housing. The spool housing can be mounted on the service belt directly behind an existing holder or can be integrally attached to a holster. A spool lock button on the spool housing provides safe and quick locking and unlocking of the gun inside the holster. The security belt does not interfere with the officer's ability to load, draw, aim and fire his weapon when needed. Tension in the security belt can be adjusted to the officer's desire.

Applicant believes that another reference corresponds to U.S. Pat. No. 4,424,924 B1 issued to Perkins on Jan. 10, 1984 for a holster with mounting spring. However, it differs from the present invention because Perkins teaches a holster for holding a handgun. The holster includes a generally U-shaped mounting spring under stiff tension against the exterior inside face of the holster. The mounting spring has a U-shaped fastening portion that fits into a pocket on the inside face of the holster. A fastener extends through the sidewall of the holster to secure the fastening portion of the spring to the holster. The holster can be worn without threading a belt through a belt loop on the holster. Instead, the mounting spring firmly but releasably clips the holster to the waistband of the user's trousers, or over the user's belt. The spring can be pulled away from the side of the holster against the bias of the spring to provide a gap for slipping the holster over the waistband or the belt, after which the spring is released, allowing the bias of the spring to clamp the holster firmly in place. The mounting spring has opposite legs extending alongside ridges formed on the inside face of the holster by a contour that matches the shape of the firearm. The legs of the spring therefore tightly clamp onto the user's clothing immediately next to and in line with the contour of the firearm, which tightly holds the holster in a fixed position. It can be used on other similar carrying cases, such as a knife sheath, or any other device, which can be clipped to not only a belt or waistband, but other articles, such as a boot or purse, for example.

Applicant believes that another reference corresponds to U.S. Pat. No. 4,325,506 B1 issued to Lindell, et al. on Apr. 20, 1982 for a reinforcing arrangement for improving the strength and durability of a firearm holster. However, it differs from the present invention because Lindell, et al. teaches a reinforcing arrangement for strengthening the back seam and outer face of a holster for guns or like items. The reinforcing arrangement is comprised of a reinforcing piece, which is attached to the inner surface of the holster's outer wall. The reinforcing piece includes a protruding arm, which extends outward from the back seam. The protruding arm is folded around the back edge of the holster's outer wall so that a portion of the arm overlaps the outer surface of the outer wall. A rivet is then used to further secure the inner and outer walls of the holster to each other. The rivet passes through a channel which is formed by a hole in the portion of the arm which overlaps the outer surface of the outer wall, a hole in the outer wall of the holster, a hole in the portion of the arm which passes between the back edges of the holster's outer and inner walls, and a hole in the holster's inner wall.

Other patents describing the closest subject matter provide for a number of more or less complicated features that fail to solve the problem in an efficient and economical way. None of these patents suggest the novel features of the present invention.

SUMMARY OF THE INVENTION

The present invention is a modular handgun holster, comprising a holster assembly having first and second internal longitudinal channels defined by first, second, third, and fourth rail guides respectively. A spacer assembly is positioned within the holster assembly. A belt clip assembly comprises first and second elongated notches interchangeably mounted onto the first or second internal longitudinal channel of the holster assembly. The belt clip assembly further comprises a first locking protrusion. A waistband clip assembly comprises third and fourth elongated notches interchangeably mounted onto the first or second internal longitudinal channel of the holster assembly. The waistband clip assembly further comprises a second locking protrusion.

The holster assembly is symmetrical or approximately symmetrical to snugly receive a handgun. The holster assembly comprises a first extension wall that extends from a first lateral edge to a first corner edge, and a second extension wall that extends from a second lateral edge to a second corner edge. Extending from the first corner edge is a first angular wall that extends to a first lateral end, and extending from the second corner edge is a second angular wall that extends to a second lateral end. Extending from the first lateral end is a first wall that extends to a third lateral end, and extending from the second lateral end is a second wall that extends to a fourth lateral end. The first wall comprises a hole that receives the first or second locking protrusions, and the second wall also comprises a hole that receives the first or second locking protrusions. Extending between the third and fourth lateral ends is a curved wall.

The first extension wall comprises first and second holes and the second extension wall comprises third and fourth holes. The spacer assembly comprises fifth and sixth holes. The first, third, and fifth holes align when the spacer assembly is positioned within the holster assembly and secured with fastening means. The second, fourth, and sixth holes align when the spacer assembly is positioned within the holster assembly and secured with fastening means.

The belt clip assembly further comprises an access hole cooperatively aligned with the first locking protrusion, and the waistband clip assembly further comprises an access hole cooperatively aligned with the second locking protrusion.

The holster assembly is worn in-between a waistband of an article of clothing and a belt. The waistband clip assembly comprises a tension arm that is fitted over the waistband, and the belt clip assembly perpendicularly wraps around a section of the belt. When the waistband clip assembly is fitted over the waistband, the tension arm is positioned on an interior side of the article of clothing. The belt is sufficiently long in length to perpendicularly pass through the belt clip assembly and wrap around the holster assembly. The article of clothing has belt loops to support the belt. The article of clothing is police apparel and/or uniforms, military apparel and/or uniforms, uniforms, jumpsuits, pants, or shorts covering at least a lower torso of a user.

It is therefore one of the main objects of the present invention to provide a modular handgun holster that is secured to and in between a user's belt and pant waistband.

It is another object of this invention to provide a modular handgun holster that is practical and secure, while provides readability for the use of the handgun kept therein.

It is another object of this invention to provide a modular handgun holster that basically includes a holster assembly, a spacer assembly, a belt clip assembly, and a waistband clip assembly.

It is another object of this invention to provide a modular handgun holster that is volumetrically efficient for carrying, transporting, and storage.

It is another object of this invention to provide a modular handgun holster that can be readily assembled and disassembled without the need of any special tools.

It is another object of this invention to provide a modular handgun holster, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
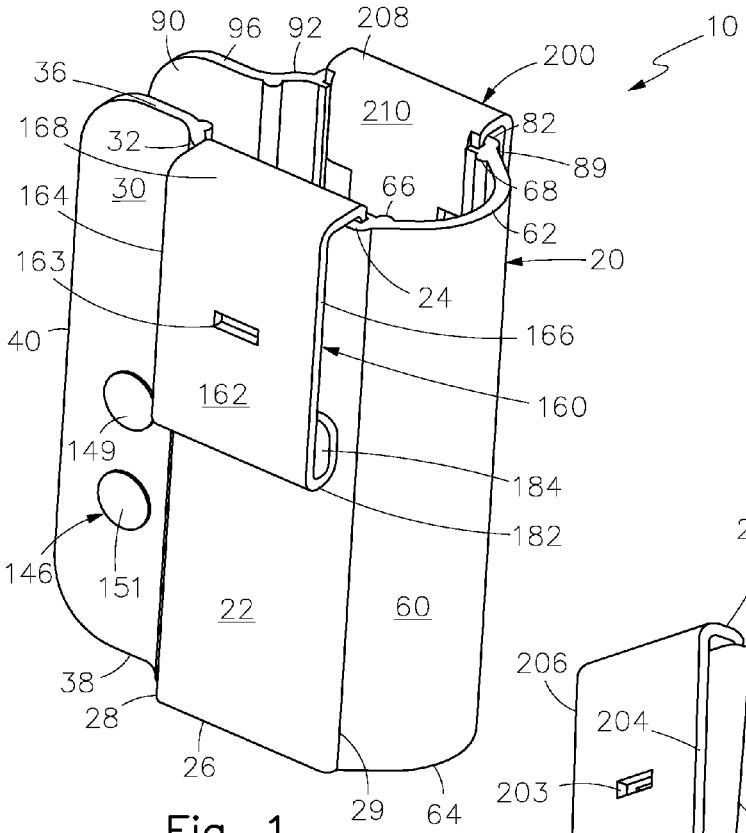
FIG. 1 is a first isometric view of a modular handgun holster, object of the present application.

Referring now to the drawings, the present invention is a modular handgun holster and is generally referred to with numeral 10. It can be observed that it basically includes holster assembly 20, spacer assembly 120, belt clip assembly 160, and waistband clip assembly 200.

Figure 2:
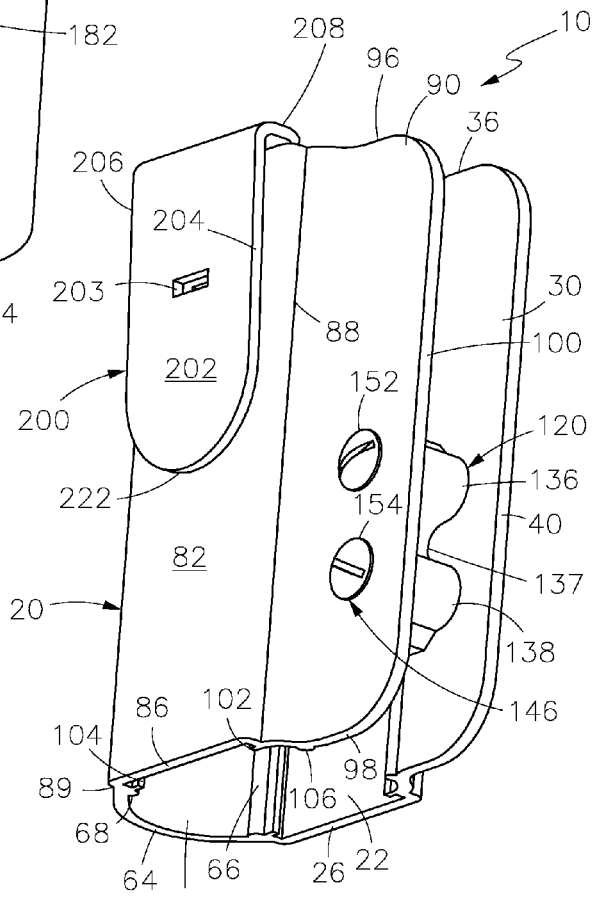
FIG. 2 is a second isometric view of the modular handgun holster.

As seen in FIGS. 1 and 2, belt clip assembly 160 and waistband clip assembly 200 are removably mounted onto holster assembly 20. Spacer assembly 120 is also secured to holster assembly 20 with sex screw assembly 146 as a fastening means.

Figure 3:
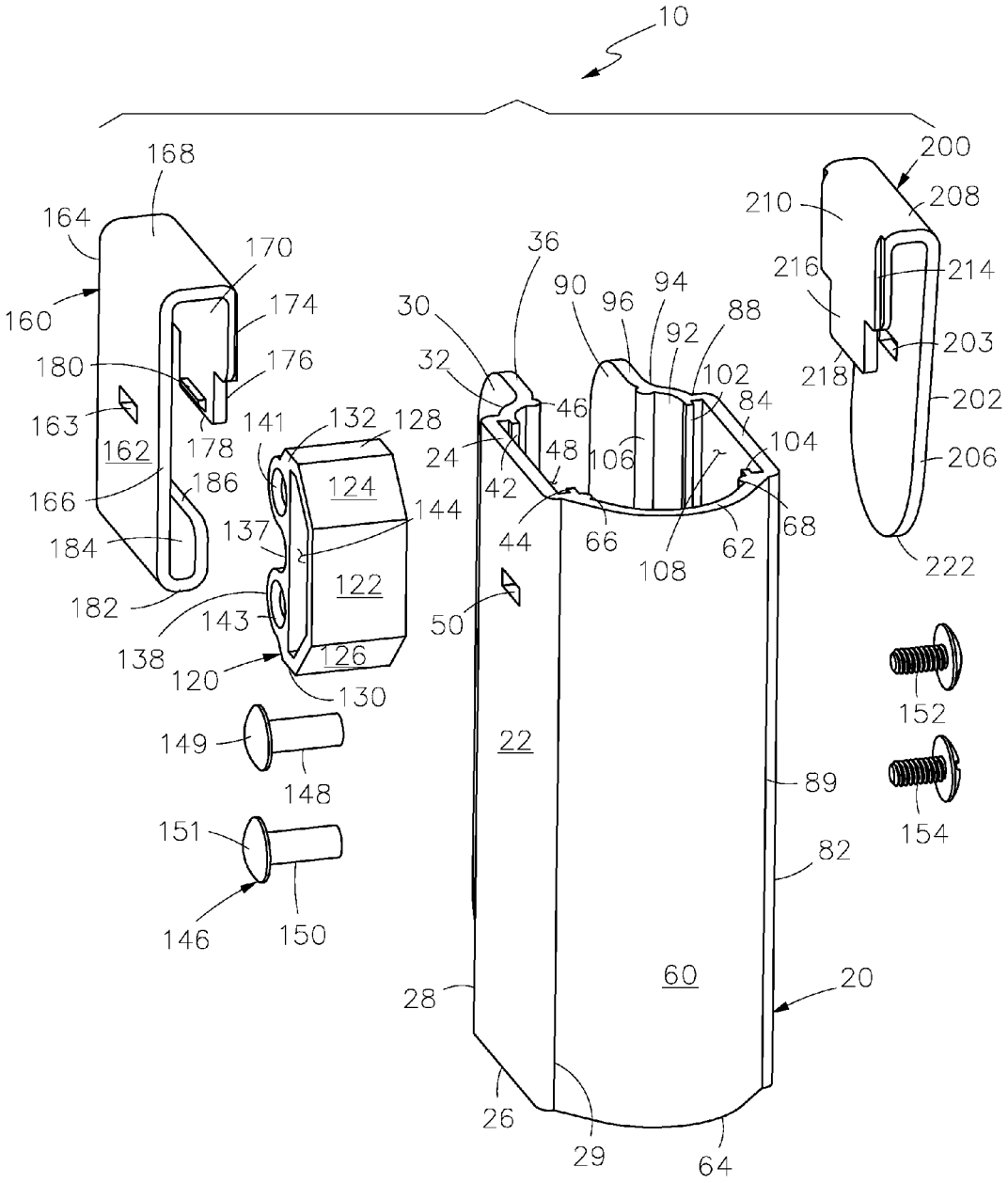
FIG. 3 is a first isometric exploded view of the modular handgun holster.
Figure 4:
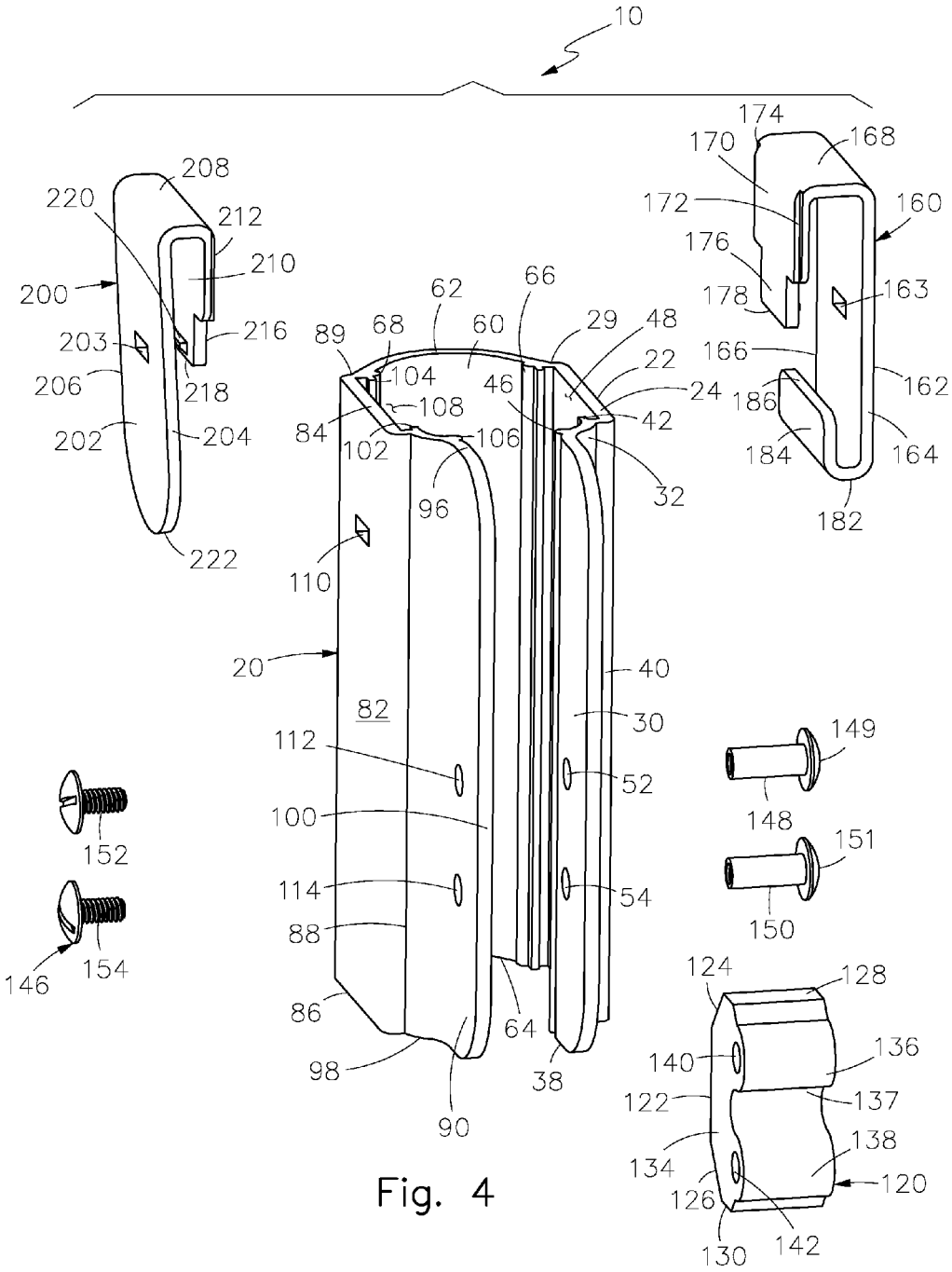
FIG. 4 is a second isometric exploded view of the modular handgun holster.

As seen in FIGS. 3 and 4, holster assembly 20 comprises wall 22, curved wall 60, and wall 82. Wall 22 extends between top edge 24 and bottom edge 26. Wall 22 has lateral ends 28 and 29 that are approximately perpendicular to top and bottom edges 24 and 26. Extending from lateral end 28 is extension wall 30 defined by top edge 36, bottom edge 38, and lateral edge 40.

Rail guides 42 and 44 extend inwardly from lateral ends 28 and 29, and extend longitudinally from top edge 24 to bottom edge 26, substantially parallel to wall 22. Rail guides 42 and 44 define internal longitudinal channel 48.

Wall 22 further comprises hole 50 disposed at a predetermined distance from top edge 24. Holes 52 and 54 are spaced apart from each other and are cooperatively disposed at extension wall 30 at a predetermined distance from lateral edge 40.

Wall 82 extends between top edge 84 and bottom edge 86, and has lateral ends 88 and 89 that are approximately perpendicular thereto. Extending from lateral end 88 is extension wall 90 defined by top edge 96, bottom edge 98, and lateral edge 100. Extension wall 90 has angular wall 92, which extends adjacent to lateral end 88 into corner edge 94. Rail guides 102 and 104 extend inwardly from lateral ends 88 and 89, and extend longitudinally from top edge 84 to bottom edge 86, substantially parallel to wall 82. Rail guides 102 and 104 define internal longitudinal channel 108. Rib 106 also extends longitudinally at the internal side of corner edge 94.

Wall 82 further comprises hole 110 disposed at a predetermined distance from top edge 84. Holes 112 and 114 are spaced apart from each other and are cooperatively disposed at extension wall 90 at a predetermined distance from lateral edge 100. Hole 112 is cooperatively aligned with hole 52, and hole 114 is cooperatively aligned with hole 54.

Curved wall 60 extends between top edge 62 and bottom edge 64, and extends from lateral end 29 to lateral end 89. Rib 66 extends longitudinally at the internal side of curved wall 60, adjacent to lateral end 29, and rib 68 extends longitudinally at the internal side of curved wall 60, adjacent to lateral end 89.

Spacer assembly 120 has a cooperative shape and dimension to be removably mounted between extension walls 30 and 90. Spacer assembly 120 comprises wall 122. Angular walls 124 and 126 extend from wall 122 at an angle. Top wall 128 and bottom wall 130 extend from angular walls 124 and 126 respectively. Top wall 128 and bottom wall 130 are substantially perpendicular to wall 122. Opposite to wall 122 are ridges 136 and 138 separated by furrow 137. Wall 122, angular walls 124 and 126, top and bottom walls 128 and 130, ridges 136 and 138, and furrow 137 extend between sidewalls 132 and 134. Ridges 136 and 138 have countersink holes 140 and 142, respectively, also extending between sidewalls 132 and 134. Countersink holes 140 and 142 have countersinks 141 and 143 at sidewall 132. Cavity 144 extends from sidewall 132 towards sidewall 134 without reaching sidewall 134. Cavity 144 is intended to make spacer assembly 120 lightweight.

Sex screw assembly 146 comprises female bolts 148 and 150, and screws 152 and 154. Female bolts 148 and 150 have heads 149 and 151, respectively. It is noted that holes 52 and 54 are of cooperative diameters to receive female bolts 148 and 150 therethrough, while holes 112 and 114 are of smaller diameters to cooperatively receive screws 152 and 154 therethrough. In addition, countersink holes 140 and 142, of spacer assembly 120, are of a cooperative diameter to receive female bolts 148 and 150 therethrough.

To assemble, spacer assembly 120 is positioned between extension walls 30 and wall 90, in a way that countersink hole 140 is aligned with holes 52 and 112, and countersink 141 is adjacent to hole 52. Also, countersink hole 142 is aligned with holes 54 and 114, and countersink 143 is adjacent to hole 54. Once female bolts 148 and 150 go through holes 52 and 54, countersinks 141 and 143 guide female bolts 148 and 150 through countersink holes 140 and 142, respectively. Distal ends of female bolts 148 and 150 receive screws 152 and 154 that pass through holes 112 and 114, respectively.

Belt clip assembly 160 comprises lateral edges 164 and 166, and further comprises wall 162, top wall 168, upper interior wall 170 and lower interior wall 184. Wall 162 has access hole 163. Extending from upper interior wall 170 is tongue 176, which terminates at edge 178. Tongue 176 has locking protrusion 180 extending inwardly. Upper interior wall 170 has elongated notches 172 and 174 adjacent to lateral edges 164 and 166, respectively. Lower interior wall 184 is connected to wall 162 by bottom bend 182. Lower interior wall 184 terminates at edge 186.

Waistband clip assembly 200 comprises lateral edges 204 and 206, and further comprises wall 202, top wall 208, and tension arm 210. Wall 202 has access hole 203. Tension arm 210 is connected to wall 202 by top wall 208. Extending from tension arm 210 is tongue 216, which terminates at edge 218. Tongue 216 has locking protrusion 220 protruding inwardly. Tension arm 210 has elongated notches 212 and 214 adjacent to lateral edges 204 and 206, respectively. Wall 202 terminates at end 222.

Figure 5:
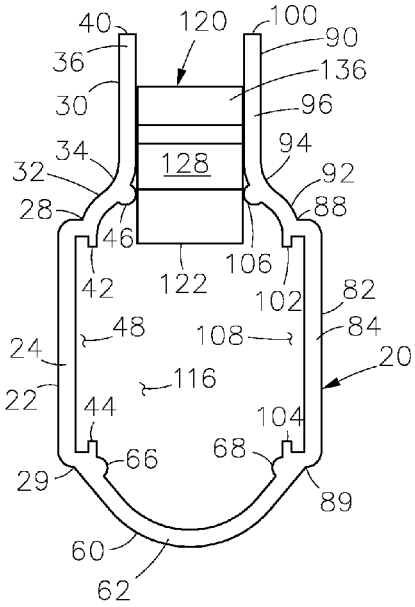
FIG. 5 is a top view of a holster assembly.
Figure 8:
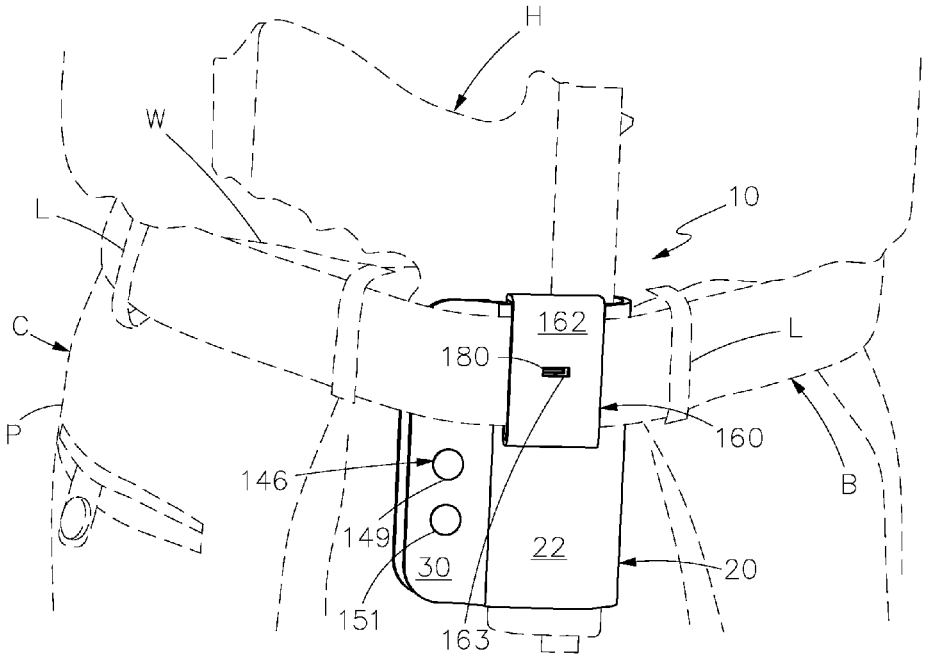
FIG. 8 is an isometric view of the present invention with a handgun holstered therein, and secured in between a user's belt and pant waistband.

As seen in FIG. 5, in a preferred embodiment, holster assembly 20 is symmetrical or approximately symmetrical to snugly receive handgun H, seen in FIG. 8, within cavity 116, whereby extension wall 30 extends from lateral edge 40 to corner edge 34, and extension wall 90 extends from lateral edge 100 to corner edge 94. Extending from corner edge 34 is angular wall 32 that extends to lateral end 28, and extending from corner edge 94 is angular wall 92 that extends to lateral end 88. Extending from lateral end 28 is wall 22 that extends to lateral end 29, and extending from lateral end 88 is wall 82 that extends to lateral end 89. Extending between lateral ends 29 and 89 is curved wall 60.

Figure 6:
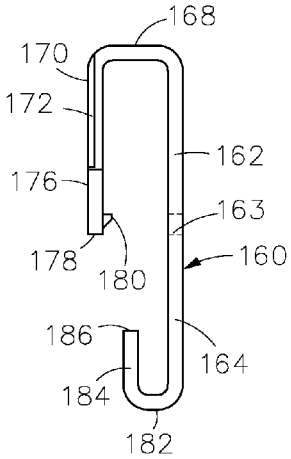
FIG. 6 is a side view of a waistband clip assembly.
Figure 7:
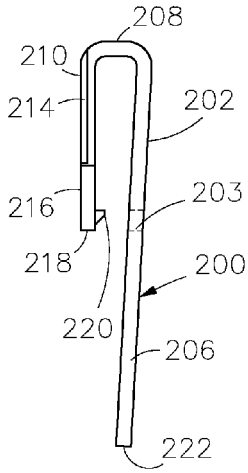
FIG. 7 is a side view of a belt clip assembly.

Internal longitudinal channel 48 is defined by rail guides 42 and 44 and receives either belt clip assembly 160 seen in FIG. 6, or waistband clip assembly 200 seen in FIG. 7. It is noted that belt clip assembly 160 and waistband clip assembly 200 are interchangeable depending on whether a user will mount present invention 10 on his/her left side, or his/her right side as illustrated in FIG. 8. To mount belt clip assembly 160 onto holster assembly 20 at internal longitudinal channel 48, elongated notch 172 is aligned between wall 22 and rail guide 42, and elongated notch 174 is aligned between wall 22 and rail guide 44. A predetermined force is placed onto belt clip assembly 160 until locking protrusion 180 snaps into/fills hole 50, seen in FIG. 3. Similarly, to mount waistband clip assembly 200 onto holster assembly 20 at internal longitudinal channel 48, elongated notch 214 is aligned between wall 22 and rail guide 42, and elongated notch 212 is aligned between wall 22 and rail guide 44. A predetermined force is placed onto waistband clip assembly 200 until locking protrusion 220 snaps into/fills hole 50, seen in FIG. 3.

Internal longitudinal channel 108 is defined by rail guides 102 and 104 and receives either belt clip assembly 160 or waistband clip assembly 200. To mount belt clip assembly 160 onto holster assembly 20 at internal longitudinal channel 108, elongated notch 172 is aligned between wall 82 and rail guide 104, and elongated notch 174 is aligned between wall 82 and rail guide 102. A predetermined force is placed onto belt clip assembly 160 until locking protrusion 180 snaps into/fills hole 110, seen in FIG. 4. Similarly, to mount waistband clip assembly 200 onto holster assembly 20 at internal longitudinal channel 108, elongated notch 214 is aligned between wall 82 and rail guide 104, and elongated notch 212 is aligned between wall 82 and rail guide 102. A predetermined force is placed onto waistband clip assembly 200 until locking protrusion 220 snaps into/fills hole 110, seen in FIG. 4.

Ribs 46, 66, 68, and 106 serve as reinforcement and/or structural integrity for holster assembly 20. Spacer assembly 120 snugly fits between extension walls 30 and 90, whereby wall 122 is positioned towards curved wall 60 to snugly receive handgun H seen in FIG. 8 within cavity 116.

As seen in FIG. 6, locking protrusion 180 is cooperatively aligned with access hole 163.

As seen in FIG. 7, locking protrusion 220 is cooperatively aligned with access hole 203.

As shown in FIG. 8, handgun H is removably received within modular handgun holster 10. Belt B may be adjusted according to user preferences. Belt B is sufficiently long in length to perpendicularly pass through belt clip assembly 160 and wrap around holster assembly 20.

In a preferred embodiment, holster assembly 20 is worn in-between waistband W of article of clothing C and belt B, whereby tension arm 210 of waistband clip assembly 200 is fitted over waistband W, and belt clip assembly 160 perpendicularly wraps around a section of belt B. A user therefore has control of handgun H fixed in between his/her waistband W and his/her belt B. Although not illustrated, it is clear that when worn in this fashion, waistband clip assembly 200 is fitted over waistband W, and tension arm 210 is positioned on an interior side of article of clothing C, as opposed to visible exterior side of article of clothing C illustrated in this figure.

Alternate ways to wear holster assembly 20 include positioning it on the interior side of article of clothing C, or on the interior side of waistband W, or on the exterior side of belt B. Article of clothing C may be a pant P, or any other article of clothing having belt loops L to support belt B. Such an article of clothing having belt loops L to support a belt B can be, but is not limited to, police apparel and/or uniforms, military apparel and/or uniforms, uniforms, jumpsuits, pants, shorts, or any other article of clothing covering at least a lower torso of the user. Present invention 10 may also be mounted onto any structure that accommodates or receives belt clip assembly 160 and/or waistband clip assembly 200.

When holstered, handgun H fits and adjusts within cavity 116. Modular handgun holster 10 provides the user confidence that handgun H is safely secured and accessible.

To remove belt clip assembly 160 from holster assembly 20, a user inserts any object with a predetermined force through access hole 163 and either hole 50 or 110, depending on which side it is mounted, and onto locking protrusion 180 until it is released from the respective hole 50 or 110.

Similarly, to remove waistband clip assembly 200 from holster assembly 20, a user inserts any object with a predetermined force through access hole 203 and either hole 50 or 110, depending on which side it is mounted, and onto locking protrusion 220 until it is released from the respective hole 50 or 110.

Handgun holster 10 is made of a semi-rigid material such as plastic, acrylic, fiberglass, or any suitable material having similar characteristics.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A modular handgun holster, comprising:

A) a holster assembly comprising first and second internal longitudinal channels defined by first, second, third, and fourth rail guides respectively;

B) a spacer assembly positioned within said holster assembly;

C) a belt clip assembly comprising first and second elongated notches interchangeably mounted onto said first or second internal longitudinal channel of said holster assembly, said belt clip assembly further comprising a first locking protrusion; and D) a waistband clip assembly comprising third and fourth elongated notches interchangeably mounted onto said first or second internal longitudinal channel of said holster assembly, said waistband clip assembly further comprising a second locking protrusion.

2. The modular handgun holster set forth in claim 1, further characterized in that said holster assembly is symmetrical or approximately symmetrical to snugly receive a handgun.

3. The modular handgun holster set forth in claim 1, further characterized in that said holster assembly comprises a first extension wall that extends from a first lateral edge to a first corner edge, and a second extension wall that extends from a second lateral edge to a second corner edge.

4. The modular handgun holster set forth in claim 3, further characterized in that extending from said first corner edge is a first angular wall that extends to a first lateral end, and extending from said second corner edge is a second angular wall that extends to a second lateral end.

5. The modular handgun holster set forth in claim 4, further characterized in that extending from said first lateral end is a first wall that extends to a third lateral end, and extending from said second lateral end is a second wall that extends to a fourth lateral end.

6. The modular handgun holster set forth in claim 5, further characterized in that said first wall comprises a hole that receives said first or second locking protrusions.

7. The modular handgun holster set forth in claim 5, further characterized in that said second wall comprises a hole that receives said first or second locking protrusions.

8. The modular handgun holster set forth in claim 5, further characterized in that extending between said third and fourth lateral ends is a curved wall.

9. The modular handgun holster set forth in claim 3, further characterized in that said first extension wall comprises first and second holes and said second extension wall comprises third and fourth holes.

10. The modular handgun holster set forth in claim 9, further characterized in that said spacer assembly comprises fifth and sixth holes.

11. The modular handgun holster set forth in claim 10, further characterized in that said first, third, and fifth holes align when said spacer assembly is positioned within said holster assembly and secured with fastening means.

12. The modular handgun holster set forth in claim 10, further characterized in that said second, fourth, and sixth holes align when said spacer assembly is positioned within said holster assembly and secured with fastening means.

13. The modular handgun holster set forth in claim 1, further characterized in that said belt clip assembly further comprises an access hole cooperatively aligned with said first locking protrusion.

14. The modular handgun holster set forth in claim 1, further characterized in that said waistband clip assembly further comprises an access hole cooperatively aligned with said second locking protrusion.

15. The modular handgun holster set forth in claim 1, further characterized in that said holster assembly is worn in-between a waistband of an article of clothing and a belt.

16. The modular handgun holster set forth in claim 15, further characterized in that said waistband clip assembly comprises a tension arm that is fitted over said waistband, and said belt clip assembly perpendicularly wraps around a section of said belt.

17. The modular handgun holster set forth in claim 16, further characterized in that when said waistband clip assembly is fitted over said waistband, said tension arm is positioned on an interior side of said article of clothing.

18. The modular handgun holster set forth in claim 17, further characterized in that said belt is sufficiently long in length to perpendicularly pass through said belt clip assembly and wrap around said holster assembly.

19. The modular handgun holster set forth in claim 18, further characterized in that said article of clothing has belt loops to support said belt.

20. The modular handgun holster set forth in claim 19, further characterized in that said article of clothing is police apparel and/or uniforms, military apparel and/or uniforms, uniforms, jumpsuits, pants, or shorts covering at least a lower torso of a user.

* * * * *